US007810585B2

(12) United States Patent
Downton

(10) Patent No.: US 7,810,585 B2
(45) Date of Patent: Oct. 12, 2010

(54) BI-DIRECTIONAL ROTARY STEERABLE SYSTEM ACTUATOR ASSEMBLY AND METHOD

(75) Inventor: Geoff Downton, Gloucestershire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 504 days.

(21) Appl. No.: 11/322,114

(22) Filed: Dec. 29, 2005

(65) Prior Publication Data

US 2006/0157281 A1 Jul. 20, 2006

(30) Foreign Application Priority Data

Jan. 20, 2005 (GB) ..... 0501222.4

(51) Int. Cl.
*E21B 7/04* (2006.01)

(52) U.S. Cl. ..... 175/73; 175/61; 175/107; 91/454

(58) Field of Classification Search ..... 175/61, 175/73; 137/100; 91/454
See application file for complete search history.

(56) References Cited

U.S. PATENT DOCUMENTS 3,713,500 A * 1/1973 Russell ..... 175/73
4,416,187 A * 11/1983 Nystrom ..... 91/361
5,473,939 A * 12/1995 Leder et al. ..... 73/152.12
5,685,379 A 11/1997 Barr et al.
6,659,201 B2 * 12/2003 Head et al. ..... 175/61
2004/0016571 A1 * 1/2004 Krueger ..... 175/61
2004/0089477 A1 5/2004 Moody et al.
2004/0245019 A1 * 12/2004 Hartwick ..... 175/57

FOREIGN PATENT DOCUMENTS

EP 053045 A1 * 3/1993
GB 215563 2/1924
GB 2290097 A * 12/1995
GB 2410042 7/2005
SU 1779088 A1 4/1994

* cited by examiner

*Primary Examiner*—Kenneth Thompson
*Assistant Examiner*—Sean D Andrish
(74) *Attorney, Agent, or Firm*—Vincent Loccisano; Jermy Welch; Brigitte Echols

(57) ABSTRACT

Methods and apparatuses to direct a drill bit of a directional drilling assembly are disclosed. The methods and apparatuses employ the use of bi-directional actuators that are capable of displacing a hybrid steering sleeve in positive and negative directions. The bi-directional actuators are capable of greater control and precision in their actuations than traditional "engaged-disengaged" unidirectional actuators, thereby allowing for more precise directional drilling operations. The bi-directional actuators are preferably driven by drilling fluids and may optionally be shielded to lessen the erosive effects thereof.

18 Claims, 5 Drawing Sheets

BI-DIRECTIONAL ROTARY STEERABLE SYSTEM ACTUATOR ASSEMBLY AND METHOD

CROSS-REFERENCE TO RELATED APPLICATIONS

None

BACKGROUND OF THE INVENTION

The present invention generally relates to apparatuses and methods to perform rotary steerable directional drilling operations. More particularly, the present invention relates to downhole actuators to position a drill bit assembly in a desired trajectory by a rotary steerable assembly. More particularly still, the present invention relates to a bi-directional actuator to be used in a rotary steerable system to accommodate more precise positioning of a drill bit assembly.

Boreholes are frequently drilled into the Earth's formation to recover deposits of hydrocarbons and other desirable materials trapped beneath the Earth's crust. Traditionally, a well is drilled using a drill bit attached to the lower end of what is known in the art as a drillstring. The drillstring is a long string of sections of drill pipe that are connected together end-to-end through rotary threaded pipe connections. The drillstring is rotated by a drilling rig at the surface thereby rotating the attached drill bit. The weight of the drillstring typically provides all the force necessary to drive the drill bit deeper, but weight may be added (or taken up) at the surface, if necessary. Drilling fluid, or mud, is typically pumped down through the bore of the drillstring and exits through ports at the drill bit. The drilling fluid acts both lubricate and cool the drill bit as well as to carry cuttings back to the surface. Typically, drilling mud is pumped from the surface to the drill bit through the bore of the drillstring, and is allowed to return with the cuttings through the annulus formed between the drillstring and the drilled borehole wall. At the surface, the drilling fluid is filtered to remove the cuttings and is often used recycled.

In typical drilling operations, a drilling rig and rotary table are used to rotate a drillstring to drill a borehole through the subterranean formations that may contain oil and gas deposits. At downhole end of the drillstring is a collection of drilling tools and measurement devices commonly known as a Bottom Hole Assembly (BHA). Typically, the BHA includes the drill bit, any directional or formation measurement tools, deviated drilling mechanisms, mud motors, and weight collars that are used in the drilling operation. A measurement while drilling (MWD) or logging while drilling (LWD) collar is often positioned just above the drill bit to take measurements relating to the properties of the formation as borehole is being drilled. Measurements recorded from MWD and LWD systems may be transmitted to the surface in real-time using a variety of methods known to those skilled in the art. Once received, these measurements will enable those at the surface to make decisions concerning the drilling operation. For the purposes of this application, the term MWD is used to refer either to an MWD (sometimes called a directional) system or an LWD (sometimes called a formation evaluation) system. Those having ordinary skill in the art will realize that there are differences between these two types of systems, but the differences are not germane to the embodiments of the invention.

A popular form of drilling is called "directional drilling." Directional drilling is the intentional deviation of the wellbore from the path it would naturally take. In other words, directional drilling is the steering of the drill string so that it travels in a desired direction. Directional drilling is advantageous offshore because it enables several wells to be drilled from a single platform. Directional drilling also enables horizontal drilling through a reservoir. Horizontal drilling enables a longer length of the wellbore to traverse the reservoir, which increases the production rate from the well. A directional drilling system may also be beneficial in situations where a vertical wellbore is desired. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A traditional method of directional drilling uses a bottom hole assembly that includes a bent housing and a mud motor. The bent housing includes an upper section and a lower section that are formed on the same section of drill pipe, but are separated by a permanent bend in the pipe. Instead of rotating the drillstring from the surface, the drill bit in a bent housing drilling apparatus is pointed in the desired drilling direction, and the drill bit is rotated by a mud motor located in the BHA. A mud motor converts some of the energy of the mud flowing down through the drill pipe into a rotational motion that drives the drill bit. Thus, buy maintaining the bent housing at the same azimuth relative to the borehole, the drill bit will drill in a desired direction. When straight drilling is desired, the entire drill string, including the bent housing, is rotated from the surface. The drill bit angulates with the bent housing and drills a slightly overbore, but straight, borehole.

A more modern approach to directional drilling involves the use of a rotary steerable system (RSS). In an RSS, the drill string is rotated from the surface and downhole devices force the drill bit to drill in the desired direction. Rotating the drill string is preferable because it greatly reduces the potential for getting the drillstring stuck in the borehole. Generally, there are two types of RSS, "point the bit" systems and "push the bit" systems. In a point system, the drill bit is pointed in the desired position of the borehole deviation in a similar manner to that of a bent housing system. In a push system, devices on the BHA push the drill bit laterally in the direction of the desired borehole deviation by pressing on the borehole wall.

A point the bit system works in a similar manner to a bent housing because a point system typically includes a mechanism to provide a drill bit alignment that is different from the drill string axis. The primary differences are that a bent housing has a permanent bend at a fixed angle and a point the bit RSS typically has an adjustable bend angle that is controlled independent of the rotation from the surface. A point RSS typically has a drill collar and a drill bit shaft. The drill collar typically includes an internal orienting and control mechanism that counter rotates relative to the rotation of the drillstring. This internal mechanism controls the angular orientation of the drill bit shaft relative to the borehole. The angle between the drill bit shaft and the drill collar may be selectively controlled, but a typical angle is less than 2 degrees. The counter rotating mechanism rotates in the opposite direction of the drill string rotation. Typically, the counter rotation occurs at the same speed as the drill string rotation so that the counter-rotating section maintains the same angular position relative to the inside of the borehole. Because the counter rotating section does not rotate with respect to the borehole, it is often called "geo-stationary" by those skilled in the art.

A push the bit RSS system typically uses either an internal or an external counter-rotation stabilizer. The counter rotation stabilizer remains at a fixed angle (geo-stationary) with respect to the borehole while the drillstring above is rotated. When borehole deviation is desired, an actuator presses a pad against the borehole wall in the direction opposite the desired trajectory. This operation results in a drill bit that is pushed in a desired direction. Typically, one or more actuator pads are located on a geo-stationary counter-rotating collar of the push the bit apparatus.

Historically, push the bit and point the bit rotary steerable systems use their geostationary components either to aim, or to force the drill bit in a desired direction. When subterranean formations are either unknown or especially treacherous, forcing the bit is not always feasible. In those circumstances, aiming the bit may be preferable to forcing the bit in a wrong direction. Because uncertainty of the formation is always an issue in subterranean drilling, a system having the capabilities of both point and push the bit rotary steerable systems is desirable.

BRIEF SUMMARY OF THE INVENTION

The deficiencies of the prior art are addressed by apparatuses and methods to manipulate a hybrid steering sleeve with actuator devices that are capable of positive and negative manipulation on a particular thrust axis. Preferably, the hybrid sleeve includes a plurality of bi-directional actuators to aim and force the hybrid sleeve into a preferred position and under a preferred force. The positions and forces of and exerted by the actuators are fully monitorable and controllable either by a downhole or a surface control device. The actuation of the bi-directional actuators is preferably controlled by drilling fluid pressures. A shielding mechanism is disclosed to protect any sealing components from the abrasive characteristics of the drilling fluids.

BRIEF DESCRIPTION OF THE DRAWINGS

For a more detailed description of the preferred embodiments of the present invention, reference will not be made to the accompanying drawings, wherein.

DETAILED DESCRIPTION OF THE PREFERRED EMBODIMENTS

Figure 1:
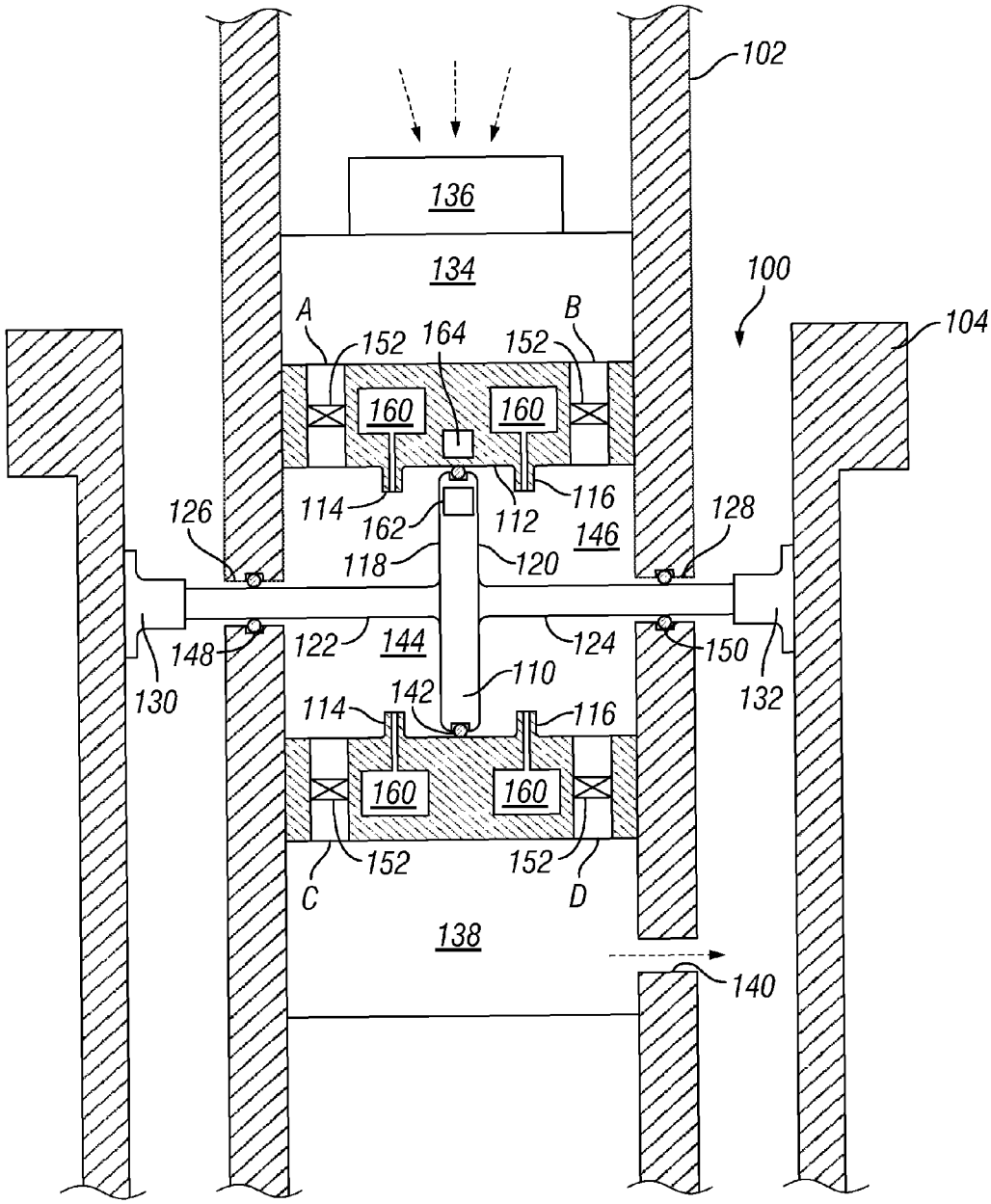
FIG. 1 is a schematic cross-sectional view of a bi-directional actuator assembly in the context of a directional drilling tool in accordance with a preferred embodiment of the present invention.

Referring initially to FIG. 1, a schematic drawing for a bi-directional actuator assembly 100 in a downhole directional drilling tool 102 is shown. Directional drilling tool 102 uses actuator assembly 100 to displace hybrid sleeve 104 into a desired position on a single axis. Hybrid sleeve 104 preferably steers a drill bit (not shown) through a geostationary universal joint (not shown) that directs drill bit as hybrid sleeve 104 is displaced relative to directional drilling tool 102. Preferably, two bi-directional actuator assemblies 100 would be employed by drilling tool 102 to form two orthogonal axis that define a plane normal to the axis of drilling tool 102, but only a single bi-directional actuator 100 (single axis) is shown for the purposes of simplicity.

Bi-directional actuator assembly 100 includes a piston 110 housed within a seal bore 112. Piston 110 is allowed to reciprocate within seal bore 112 between stops 114, 116. Piston 110 has a first thrust face 118 and a second thrust face 120 to transmit pressure forces thereupon into mechanical movement of piston 110. A first arm 122 extends from first thrust face 118 and a second arm 124 extends from second thrust face 120. Arms 122, 124 extend through ports 126, 128 of directional drilling tool 102 and engage load pads 130, 132 located upon an inside surface of hybrid sleeve 104. The movement of piston 110 within seal bore 112 transmits force through arms 122, 124 to deflect hybrid sleeve 104 in a desired position along the axis of piston 110.

Bi-directional actuator assembly 100 operates under hydraulic pressure supplied by drilling fluids. Typically, drilling fluids are delivered to the bit through the central bore of drill pipe and various drilling tools. These fluids are then used, under pressure, to lubricate the drill bit, clean the drill bit, and carry the cuttings from the borehole back to the surface. At the surface, the cuttings and impurities are filtered out and the drilling fluid, or "mud," is recycled for use again. Therefore, drilling fluids are transmitted to the bottom of a wellbore under high pressures through the bore of the drillstring and are returned to the surface at a relatively lower pressure in the annulus formed between the drillstring and the borehole wall. Because of this difference in delivery and return pressure, drilling fluids are often used to performed work in various drilling tools downhole.

Returning to FIG. 1, high-pressure drilling fluids from the bore of the drillstring enter bi-directional actuator assembly 100 at a high-pressure manifold 134 through an inlet 136. Because drilling fluids are typically slurry compositions, inlet 136 preferably includes some filtration mechanism to prevent solids in the drilling fluid from entering bi-directional actuator assembly 100. Low-pressure fluids of the annulus between the drillstring and the borehole are in communication with the bi-directional actuator assembly 100 through a low-pressure manifold 138 and a port 140. Manifolds 134, 138 are shown schematically as simple manifolds, but complex systems utilizing various ducts, valves, and controls may be employed. High-pressure manifold 134 communicates with piston 110 through ports A and B. Low-pressure manifold 138 communicates with piston 110 through ports C and D.

A seal 142 mounted to piston 110 reciprocating within seal bore 112 creates a first pressure chamber 144 and a second pressure chamber 146 of bi-directional actuator assembly 100. Seal 142 is shown schematically as a single o-ring seal but it should be known by one of ordinary skill in the art that any type of dynamic seal may be used. For example, double o-rings, wipers, and backup rings may be used to improve the reliability and integrity of seal 142.

First pressure chamber 144 acts on first face 118 of piston 110 and tends to urge piston 110 to the right when pressure therein is increased relative to second pressure chamber 146. Second pressure chamber 146 acts on second face 120 of piston 110 and tends to urge piston 110 to the left when pressure therein is increased relative to first pressure chamber 144. Seals 148, 150 maintain integrity of first and second pressure chambers 144, 146, respectively, by preventing annulus fluid from communicating with chambers 144,146. High-pressure port A and low-pressure port C are in communication with first pressure chamber 144. High-pressure port B and low-pressure port D are in communication with second pressure chamber 146. Valves 152, shown schematically within ports A, B, C, and D, selectively allow or restrict the flow of drilling fluids from manifolds 134, 138 in or out of chambers 144, 146. While valves 152 are shown schematically as integral to ports A, B, C, and D, it should be understood by one of ordinary skill in the art that various configurations and locations for valves 152 may be used. Particularly, ports A, B may be integral to manifold 134 and ports C, D may be integral to manifold 138. Valves 152 are shown as is for illustrative purposes only and are not meant to be limiting on the scope of the claims.

Optionally, a dynamic feedback system may be used with the bi-directional piston actuator assembly 100 of FIG. 1. Particularly, a series of pressure transducers 160 may be installed in communication with first and second chambers 144, 146 to monitor the relative pressure difference between chambers 144, 146. Next, a N-S magnet device 162 may be mounted to the piston 110 such that a magnetic proximity (Hall Effect) detector 164 can determine the absolute position of piston 110 within seal bore. The information from the proximity detector 164 and the pressure transducers 160 can be either relayed to a processing unit (not shown) within directional drilling tool 102 or may be sent, via telemetry, to an operator at the surface. This information and the data created therefrom can be analyzed and used by to determine performance of bi-directional actuator assembly 100 and to determine what corrections, if any, are needed to steer the directional drilling tool 102 into its desired trajectory. Furthermore, using the data from transducers 160 and detector 164, an operator can know the position of hybrid sleeve 104 with respect to drilling tool 102 at all times. Therefore, the controller or the operator can know the difference between the desired bid direction and the actual bit direction and be able to make adjustments thereof. While pressure transducers and magnetic sensors are shown to obtain pressure and position data for piston 110 and chambers 144, 146, it should be understood by one of ordinary skill in the art that other Referring now to FIG. 2, piston 110 is shown displaced to the right, thus placing a "positive" bias upon hybrid sleeve 104. To displace piston 110 in this manner, high-pressure drilling fluid from the bore of drillstring and directional drilling tool 102 enters high-pressure manifold 134 through filtration screen 136. A controller (not shown) selectively opens port A and closes port B, thus allowing pressure within first chamber 144 to increase. The controller simultaneously opens port D and closes port C of the low-pressure manifold 138, thereby allowing pressure within second chamber 146 to decrease. As pressure builds within first chamber 144, that pressure acts upon face 118 and drives piston 110 toward the right side (positive displacement) until stop 116 is engaged. The movement of piston 110 to the right, likewise displaces second arm 124 to the right enabling the application of force to hybrid sleeve 104 through load pad 132. Hybrid sleeve 104 displaces to the right under the force of piston 110, arm 124, and pad 132, thereby directing the drill bit (not shown) into a desired trajectory. Pressure transducers 160, if present, are able to report the pressure difference between first chamber 144 and second chamber 146 so that the operator or controller knows the amount of force applied to hybrid sleeve 104. Furthermore, proximity detector 164 and magnet 162, if present, are able to report the absolute position of piston 110 so that controller or operator knows the amount of deflection experienced by hybrid sleeve 104.

Figure 3:
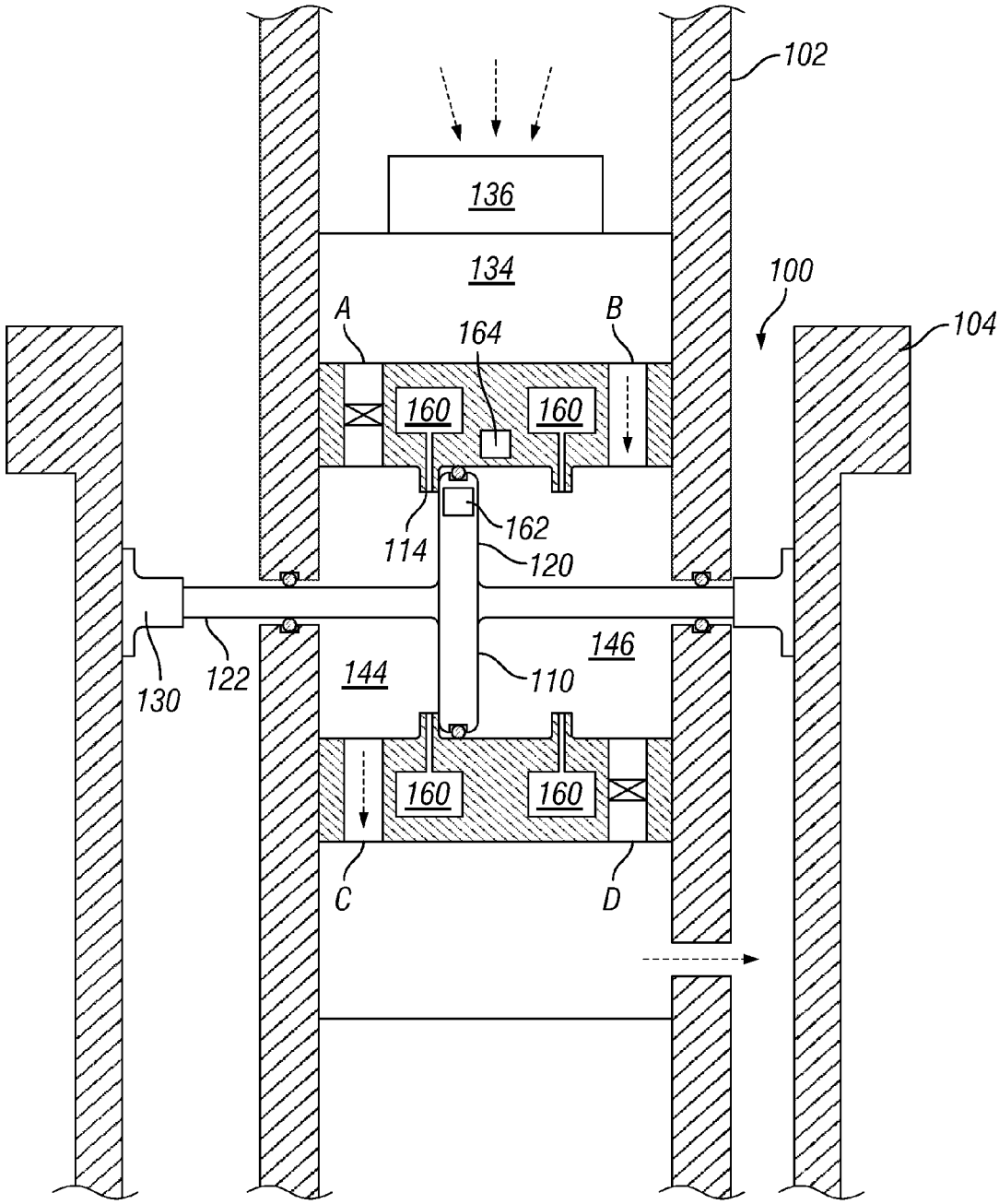
FIG. 3 is a schematic cross-sectional view of the bi-directional actuator assembly of FIG. 1 in a negatively biased state.

Referring briefly to FIG. 3, piston 110 is shown displaced to the left, thus placing a "negative" bias upon hybrid sleeve 104. To displace piston 110 in this manner, high-pressure drilling fluid enters second chamber 146 as high-pressure port B is opened and high-pressure port A is closed. Simultaneously, low-pressure port C is opened and low-pressure port D is closed to allow first chamber 144 to communicate with the low-pressure annular drilling fluids of through manifold 138 and port 140. High-pressure fluids are thus allowed to enter second chamber 146 and press against face 120 to deflect piston 110 to the left, in a "negative" direction of travel. The displacement of piston 110 to the left thus allows force to be transmitted from piton 110 through first arm 122 and first pad 130 to hybrid sleeve 104. As before, pressure transducers 160, and magnetic sensors 162, 164, if present, allow a controller, or an operator to monitor the load and displacement of hybrid sleeve 104 resulting from bi-directional actuator assembly 100.

Figure 4:
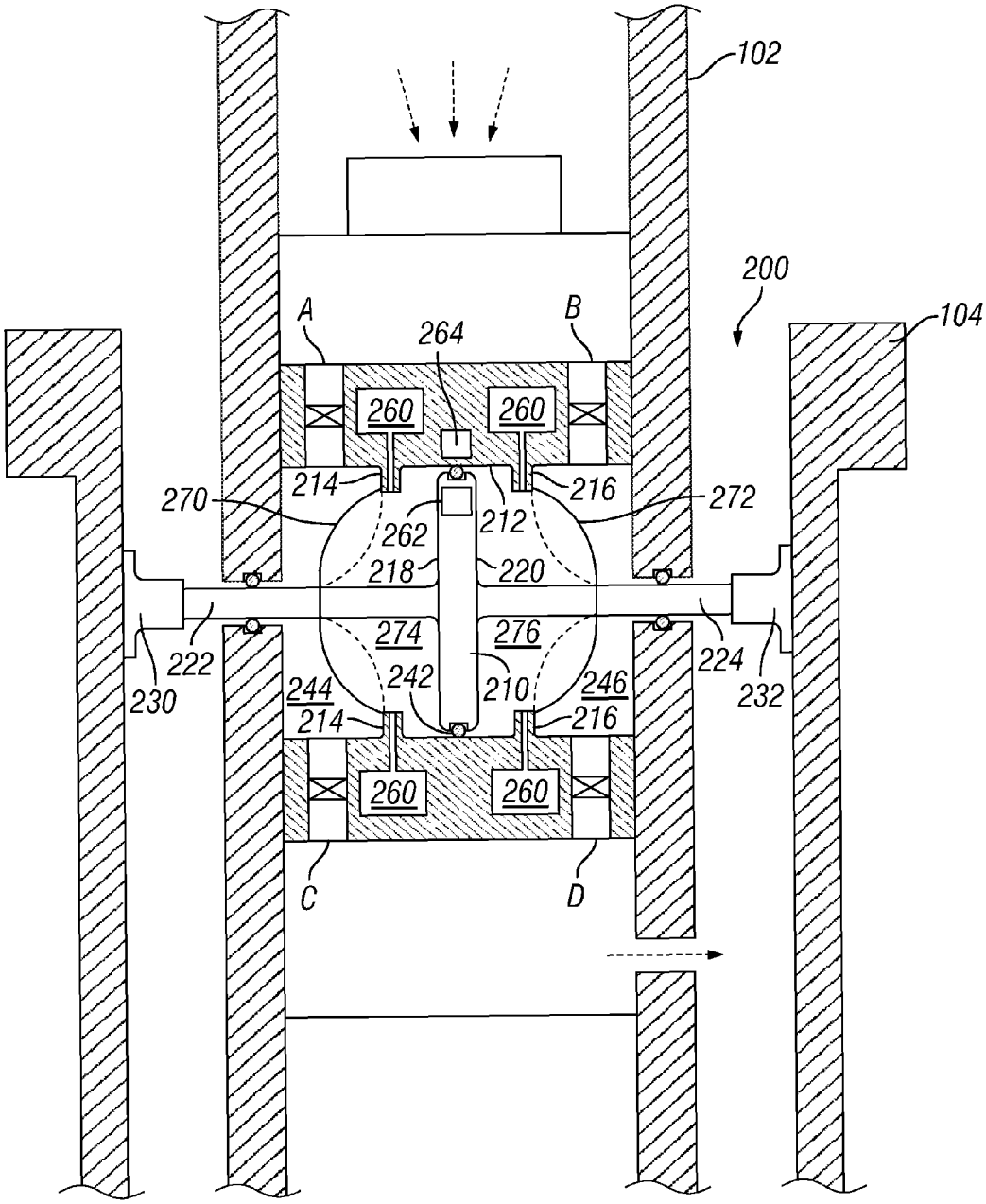
FIG. 4 is a schematic cross-sectional view of the bi-directional actuator assembly of FIG. 1 further including a protective membrane.

Referring now to FIG. 4, a bi-directional piston actuator assembly 200 with an integrated membrane shield system is shown. Piston actuator assembly 200, like assembly 100, includes a piston 210 that reciprocates within a seal bore 212 between two stops 214, 216. Because the operating fluid of piston 110 is drilling fluid, problems with wear and abrasion of sealing surfaces often arises through frequent use. Drilling fluid, as a slurry composition, includes many solid and particulates within the fluid itself. These particulates can often be of elevated hardness and can scratch or abrade seal bore 212 over time. Any such abrasions would severely limit the amount of force transferable from piston 210 to hybrid sleeve 104 through arms 222, 224, severely reducing the effectiveness of piston actuator assembly (100 of FIGS. 1-3). To overcome this problem, the present invention includes the addition of membrane shields 270, 272 within first and second pressure chambers 244, 246. Membrane shields 270, 272 preferably extend, in a conical-like shape, from first and second stops 214, 216 to first and second arms 222, 224, respectively. Membranes 270,272 are preferably constructed from a durable, wear resistant flexible material such as a reinforced elastomer. Membranes 270, 272, in effect, create two new "clean" pressure chambers 274, 276 where a "clean" hydraulic fluid (or oil) is maintained against faces 218, 220 of piston 210, seal 242, and seal bore 212. Clean hydraulic fluid within clean chambers 274, 276 will be free of particulates and impurities that would otherwise harm the integrity of seal 242.

Figure 2:
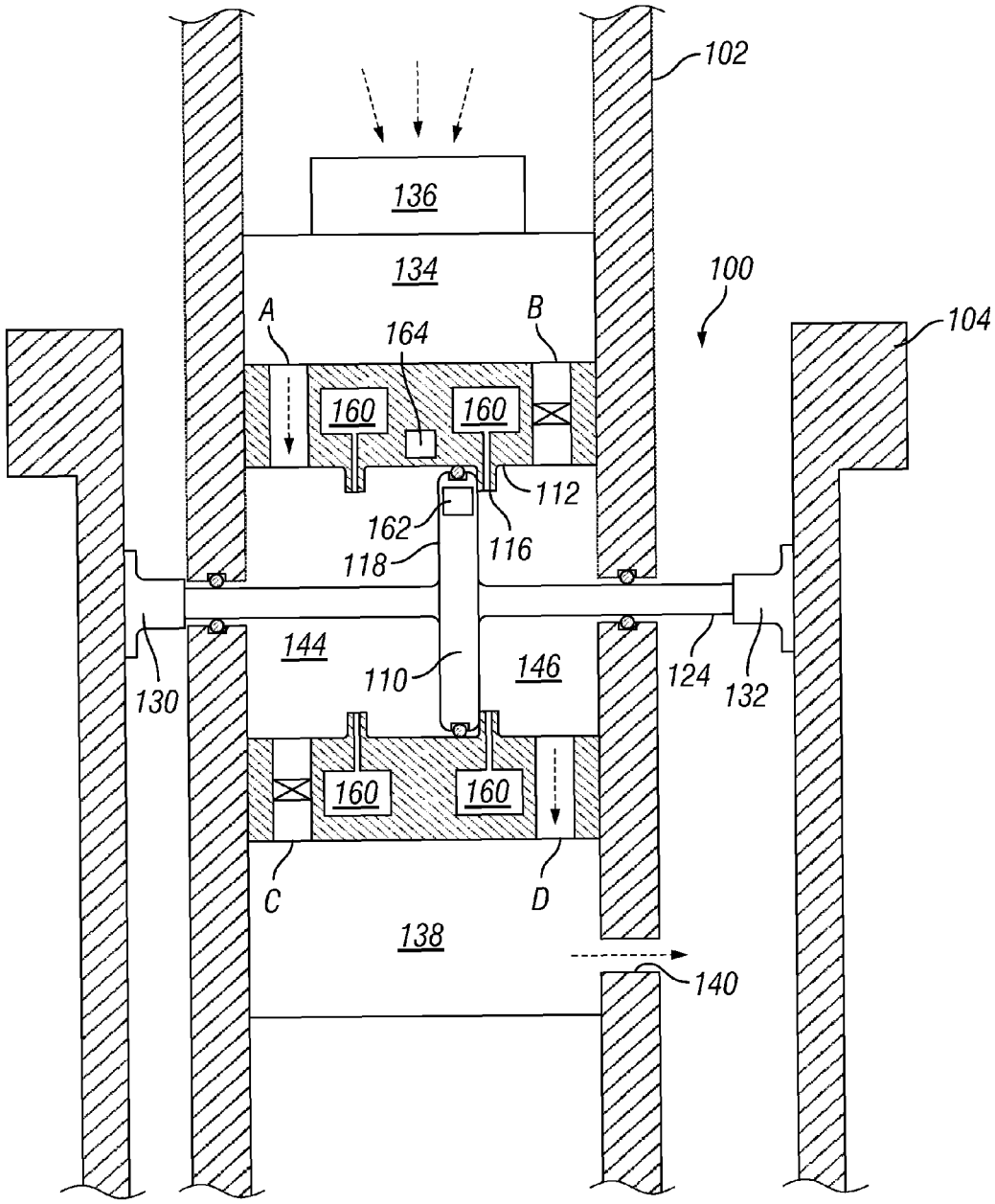
FIG. 2 is a schematic cross-sectional view of the bi-directional actuator assembly of FIG. 1 in positively biased state.

In operation, valves A, B, C, and D are opened and shut as with actuator assembly 100 of FIGS. 1-3 to deflect piston 210 either in a positive or negative direction. With membranes 270. 272 and clean pressure chambers 274. 276. drilling fluids never come into contact with sensitive seal components. For example, in actuating piston to the right (positive direction), high-pressure drilling fluid is allowed to communicate with first chamber 244 through port A and low-pressure drilling fluid is allowed to communicate with second chamber 246 through port D, leaving ports B and C closed. The high-pressure fluid would build up in chamber 244 and would impact force and pressure upon membrane 270, thus transferring the force and pressure thereupon to clean hydraulic fluid contained within clean chamber 274. The elevated pressure of clean fluid within chamber 274 would thereby exert force upon face 218 and drive piston 210 to the right. Similarly, to drive piston 210 to the left (negative direction), ports B and C would be opened with ports A and D closed to allow high-pressure fluid to flow into second chamber 246. Fluid in chamber 246 would likewise press upon membrane 272 and transmit pressure to clean fluid in chamber 276, thereby exerting force upon face 220 and displacing piston 210 to the left.

Preferably high-pressure ports A and B are constructed so that the high-pressure flow of drilling fluid flowing into chambers 244, 246 does not impact membranes 270, 272 directly. Any direct impact of high-pressure drilling fluid thereupon could abrade away or tear membranes 270, 272, thus sacrificing their integrity. To accomplish this, either ports A, and B can be constructed to direct flow of high-pressure fluids away from membranes 270, 272 or shields (not shown) can be constructed within chambers 244, 246 to direct the flow. As with actuator assembly 100 of FIGS. 1-3, pressure transducers 260, and magnetic proximity components 262 and 264 can be employed to allow a controller or an operator to monitor the position of and forces upon hybrid sleeve 104.

Typical downhole actuator assemblies use actuators to engage or disengage three kick pads about the periphery of the directional drilling tool. These traditional pads operate only in one direction and therefore are either engaged or disengaged. Therefore, the number of possible force conditions that are possible are limited to 6 non-zero states ($2^3-1$ [all disengaged]−1 [all engaged=cancels out]=6). Actuators in accordance with the present invention are capable of 3 states each, positive engagement, negative engagement, and non-engagement. Furthermore, a drilling tool using a pair of actuators of the type describe above (preferably oriented 90° from each other) can obtain 8 different non-zero force states ($3^2-1$ [all disengaged]=8). By employing three bi-directional actuator assemblies, a drilling tool can likewise obtain 26 non-zero states. Therefore, a drilling tool using bi-directional actuator assemblies can obtain more control and precision with respect to steering the drill bit than a drilling tool with the same amount (or more) unidirectional actuators.

Figure 5:
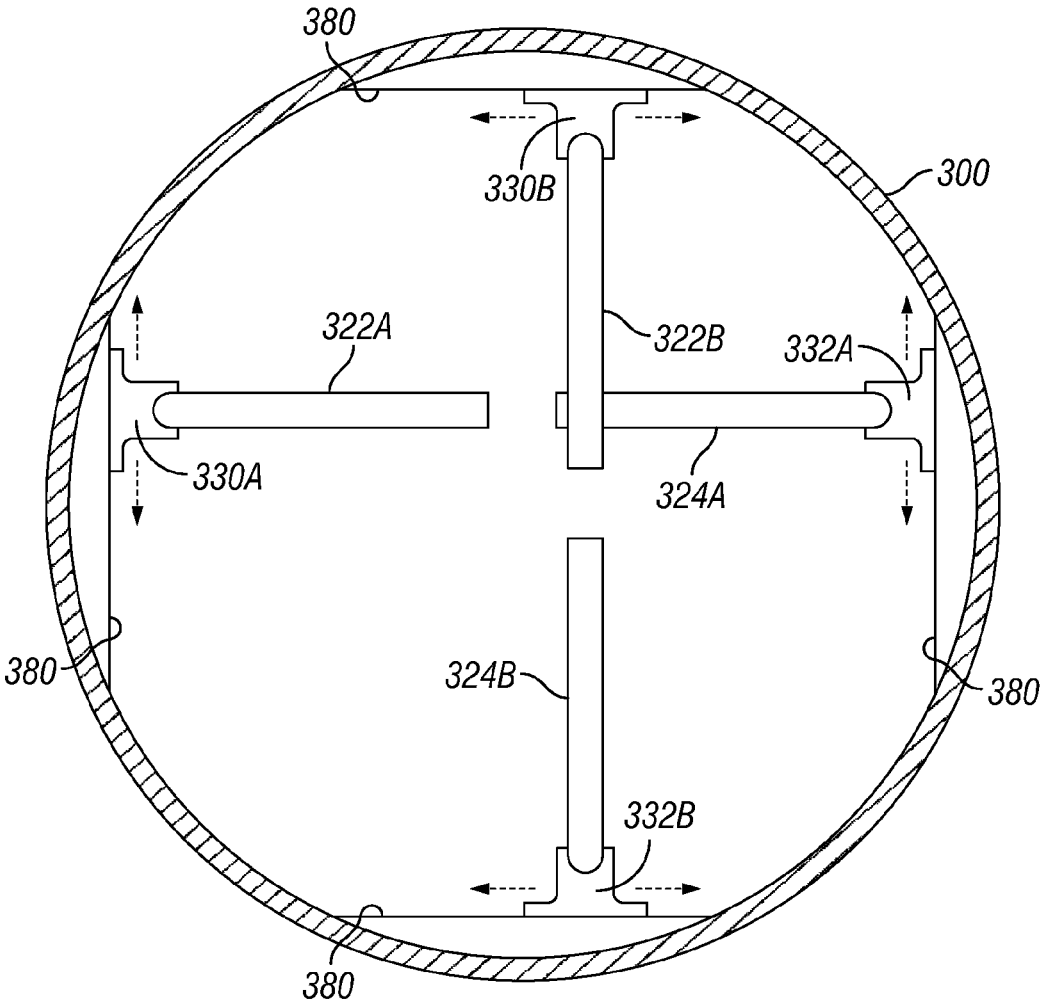
FIG. 5 is a schematic top-view drawing of a directional drilling tool utilizing two bi-directional actuator assemblies in accordance with the present invention.

Referring finally to FIG. 5, a two bi-directional actuator assembly arrangement 300 is shown schematically. Actuator arrangement 300 is shown using two actuator assemblies (100 of FIGS. 1-3 or 200 of FIG. 4) spaced 90° apart inside a hybrid sleeve 104. Arrangement 300 preferably includes parallel bearing surfaces 380 that allow load pads 330A, 330B, 332A, and 332B to slide thereupon. Parallel bearing surfaces 380 are necessary to allow hybrid sleeve 104 to move relative to drilling tool (not shown) freely and to prevent the arms 322A, 324A of one axis from restricting the arms 322B, 324B of another axis. This arrangement allows hybrid sleeve 104 to be manufactured of a relatively inflexible material, thereby maintaining its rigidity and strength.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed:

1. A bi-directional actuator to direct a rotary steerable directional drilling system in a borehole, the bi-directional actuator comprising:

a piston configured to reciprocate within a cylinder, said piston having a dynamic seal, a first thrust face, and a second thrust face;

a first arm extending from said first thrust face, said first arm configured to manipulate a hybrid sleeve of the rotary steerable system in a negative direction;

a second arm extending from said second thrust face, said second arm configured to manipulate said hybrid sleeve in a positive direction;

a first high-pressure port in communication with said first thrust face;

a second high-pressure port in communication with said second thrust face;

a first low-pressure port in communication with said first thrust face; and a second low-pressure port in communication with said second thrust face.

2. The bi-directional actuator of claim 1 wherein said first high-pressure port and said second low-pressure port are configured to thrust said piston in said positive direction when opened.

3. The bi-directional actuator of claim 1 wherein said second high-pressure port and said first low-pressure port configured to thrust said piston in said negative direction when opened.

4. The bi-directional actuator of claim 1 further comprising:

a first membrane connecting said first arm to said cylinder;

a second membrane connecting said second arm to said cylinder; and said first and said second membranes configured to isolate said dynamic seal from fluids in communication with said cylinder through said first high-pressure port, said second high-pressure port, said first low-pressure port, and said second low-pressure port.

5. The bi-directional actuator of claim 4 wherein said first and said second membranes comprise elastomers.

6. The bi-directional actuator of claim 1 further comprising mechanical stops on either side of said piston, said mechanical stops configured to limit displacement of the bi-directional actuator.

7. The bi-directional actuator of claim 1 further comprising load pads at an end of said first arm and said second arm, said load pads configured to transmit loads from said first and said second arms to said hybrid sleeve.

8. The bi-directional actuator of claim 1 further comprising pressure transducers, said pressure transducers configured to record pressure states experienced upon said first face and said second face of said piston.

9. The bi-directional actuator of claim 1 wherein said cylinder comprises a proximity detector, wherein said proximity detector is configured to determine the absolute position of said piston within said cylinder.

10. The bi-directional actuator of claim 9 wherein said proximity detector is configured to sense a magnetic field created by a N-S magnet mounted to said piston.

11. A downhole assembly to directionally drill a subterranean wellbore, the downhole assembly comprising:

a piston configured to reciprocate within a seal bore, said piston having a dynamic seal, and a pair of thrust arms extending therefrom to define a thrust axis;

said pair of thrust arms configured to manipulate a hybrid sleeve of the downhole assembly in positive and negative directions;

a first pressure chamber and a second pressure chamber, said first and said second pressure chambers isolated from each other by said dynamic seal of said piston;

a first high-pressure port in communication with said first pressure chamber;

a second high-pressure port in communication with said second pressure chamber;

a first low-pressure port in communication with said first pressure chamber; and a second low-pressure port in communication with said second pressure chamber.

12. The downhole assembly of claim 11 further comprising a first membrane connecting a first arm of said pair of thrust arms to said cylinder;

a second membrane connecting a second arm of said pair of thrust arms to said cylinder; and said first and said second membranes configured to isolate said dynamic seal from fluids in communication with said cylinder through said first high-pressure port, said second high-pressure port, said first low-pressure port, and said second low-pressure port.

13. The downhole assembly of claim 12 wherein said first and said second membranes comprise elastomers.

14. The downhole assembly of claim 11 wherein said first high-pressure port and said second low-pressure port are configured to thrust said piston in said positive direction when opened.

15. The downhole assembly of claim 11 wherein said second high-pressure port and said first low-pressure port configured to thrust said piston in said negative direction when opened.

16. The downhole assembly of claim 11 further comprising pressure transducers, said pressure transducers configured to record pressure states experienced within said first and said second pressure chambers.

17. The downhole assembly of claim 11 wherein said seal bore comprises a proximity detector, wherein said proximity detector is configured to determine an absolute position of said piston within said seal bore.

18. The downhole assembly of claim 17 wherein said proximity detector is configured to sense a magnetic field created by a N-S magnet mounted to said piston.

* * * * *